US012576302B2

(12) United States Patent
Green et al.

(10) Patent No.: US 12,576,302 B2
(45) **Date of Patent: *Mar. 17, 2026**

(54) STRUCTURE STABILIZATION SYSTEM

(71) Applicant: Core Health & Fitness, LLC, Vancouver, WA (US)

(72) Inventors: Bryan A. Green, Coeur d'Alene, ID (US); John Darren Simoni, Post Falls, ID (US)

(73) Assignee: CORE HEALTH & FITNESS, LLC, Vancouver, WA (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/753,435

(22) Filed: Jun. 25, 2024

(65) Prior Publication Data

US 2024/0342543 A1 Oct. 17, 2024

Related U.S. Application Data

(63) Continuation of application No. 17/437,007, filed as application No. PCT/US2020/021571 on Mar. 6, 2020, now Pat. No. 12,042,687.

(Continued)

(51) Int. Cl.
*A63B 21/16* (2006.01)

(52) U.S. Cl.
CPC ..... *A63B 21/16* (2013.01)

(58) Field of Classification Search
CPC . A63B 21/16; A63B 21/4027; A63B 71/0054; A63B 2071/026; A63B 71/023;

(Continued)

(56) References Cited

U.S. PATENT DOCUMENTS 4,836,535 A * 6/1989 Pearson ..... A63B 21/154
482/106
5,211,614 A * 5/1993 Henes ..... A63B 21/0628
482/133

(Continued)

FOREIGN PATENT DOCUMENTS

DE 20216170 U1 1/2003
WO WO-2020181266 A1 * 9/2020 ..... A63B 21/16

OTHER PUBLICATIONS

International Search Report and Written Opinion for International Application No. PCT/US2020/021571, mailed May 22, 2020, 14 pages.

*Primary Examiner* — Andrew M Kobylarz
(74) *Attorney, Agent, or Firm* — Sand, Sebolt & Wernow Co., LPA

(57) ABSTRACT

A stabilizing system for a modular structure is disclosed. The modular structure is intended to provide a framework for the storage of physical fitness training equipment and the support of items of exercise apparatus. Since such structures are prone to tipping, the prior art required that they be permanently fastened to either a wall or a floor. The present disclosure provides a system for obviating the need for permanent fastening by providing a foot element extending outward from the vertical support elements of the modular structure which moves the tipping point and by providing a base plate arrangement which can carry weight modules to act as a counterweight in opposition to any tipping forces.

15 Claims, 7 Drawing Sheets

Related U.S. Application Data

(60) Provisional application No. 62/815,027, filed on Mar. 7, 2019.

(58) Field of Classification Search
CPC ..... A63B 71/0036; A63B 21/1609; A63B 21/1636; A63B 21/1618; A63B 21/1627; A63B 21/1645; A63B 21/1654; A63B 21/1663; A63B 21/1672; A63B 21/1681; A63B 21/169
See application file for complete search history.

(56) References Cited

U.S. PATENT DOCUMENTS

| | | | | |
|---|---|---|---|---|
| D359,326 | S * | 6/1995 | Deola | D21/675 |
| 7,575,538 | B1 | 8/2009 | Clark | |
| 7,666,124 | B2 * | 2/2010 | Vaes | A63B 21/156 482/135 |
| 7,867,144 | B2 * | 1/2011 | Quinn | A63B 21/00181 482/142 |
| 8,147,389 | B1 * | 4/2012 | Hoole | A63B 23/1227 482/37 |
| 10,258,818 | B2 * | 4/2019 | Wilkinson | A63B 47/00 |
| 11,110,313 | B2 * | 9/2021 | Gore | A63B 21/078 |
| 11,229,822 | B1 * | 1/2022 | Manula | A63B 21/4047 |
| 11,406,857 | B1 * | 8/2022 | Cummings | G09B 9/00 |
| 12,042,687 | B2 * | 7/2024 | Green | A63B 71/023 |
| 2003/0010877 | A1 | 1/2003 | Landreville et al. | |
| 2007/0197353 | A1 * | 8/2007 | Hundley | A63B 21/4047 482/93 |
| 2016/0346582 | A1 * | 12/2016 | Wilkinson | A63B 17/04 |

* cited by examiner

STRUCTURE STABILIZATION SYSTEM

RELATED APPLICATIONS

This application is a continuation of U.S. patent application Ser. No. 17/437,007 filed on Sep. 7, 2021, which is a National Stage Entry of International Patent Application No. PCT/US2020/021571, filed on Mar. 6, 2020, which claims the benefit of U.S. Provisional Application Ser. No. 63/815,027, filed on Mar. 7, 2019, the entire disclosures of which are incorporated herein by this reference.

BACKGROUND OF THE INVENTION

The present invention relates to functional types of physical training apparatus and, more particularly, a stabilizing system that does not require anchoring using permanent fasteners or protruding structures into the physical workout floor or wall space. Bolted anchoring requirements limit the potential for apparatus installation due to various causes. However, the most common issues are insufficient strength of the grounding medium or the damage the bolting will cause to the property. Means of stability through excess structure protruding into the workout space creates trip or bump hazards and limits the functionality of the space.

In the past, modular structures have been used as a framework for a variety of physical training devices, as well as for providing storage for equipment such as exercise balls, bar bells, kettle balls and free weights, all used for physical training. In addition, a framework was provided for mounting exercise straps, bands, punching bags and suspension equipment.

Unless such structures were either permanently fastened to a wall or floor surface, or the structure maintained a wide three to four-point floor contact footprint similar to a table, there was a danger that vigorous exercise by one or more participants could cause the structure to tip over and fall, endangering all in the area. The danger came, not only from the structure itself, but also from all of the training equipment that was stored on the structure.

SUMMARY OF THE INVENTION

According to the present invention, a modular structure is mounted on a base plate with aligning rods, over which can be placed weight modules. It has been found that modules totaling loads of from 100 to 800 pounds may be installed, depending the size of the structure.

In addition, a foot member, which extends outwardly from the vertical member of the modular structure, moves the point of rotation from the base of the vertical member to the extending end of the foot. The amount of weight needed to stabilize the structure can then be calculated based on the length of the foot, weight of the structure, and the structure's required resistance to a load of magnitude and direction due to exercise movement.

The novel features which are characteristic of the invention, both as to structure and method of operation thereof, together with further objects and advantages thereof, will be understood from the following description, considered in connection with the accompanying drawings, in which the preferred embodiment of the invention is illustrated by way of example. It is to be expressly understood, however, that the drawings are for the purpose of illustration and description only, and they are not intended as a definition of the limits of the invention.

BRIEF DESCRIPTION OF THE DRAWINGS

FIG. 3, including FIG. 3B is a section seen along the line 3B in FIG. 3A in the direction of the appended arrows and FIG. 3C is a section view taken along line 3C in FIG. 3A in the direction of the appended arrows;

DETAILED DESCRIPTION OF THE INVENTION

Figure 1:
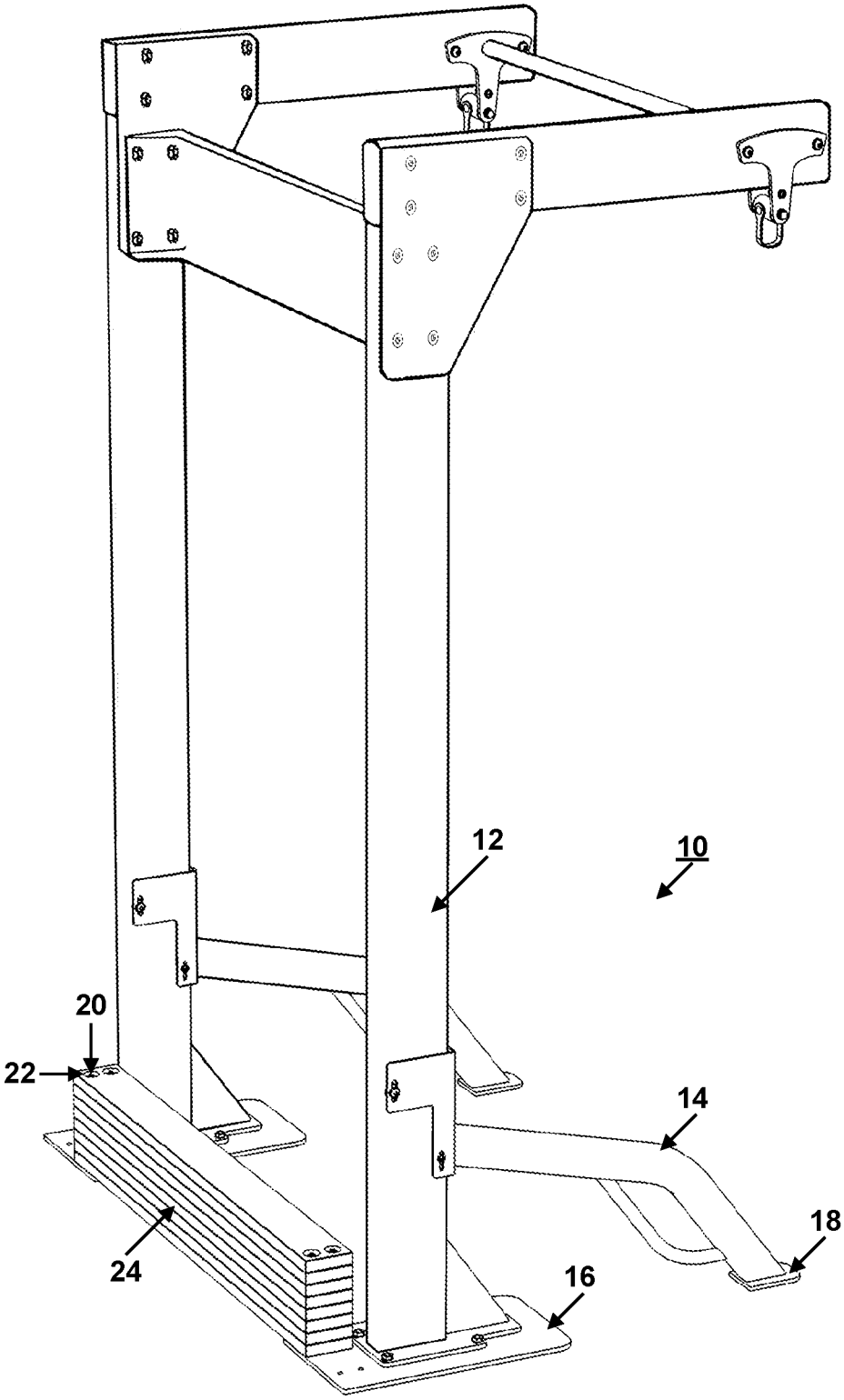
FIG. 1 is a perspective view of a modular structure equipped with the present invention.

Turning first to FIG. 1, there is shown, in exploded perspective view, a stabilizing structure 10 according to the present invention. The structure 10 is attached to vertical members or posts 12 of a modular structure. The stabilizing structure includes a plurality of elements that are connected together.

Figure 6:
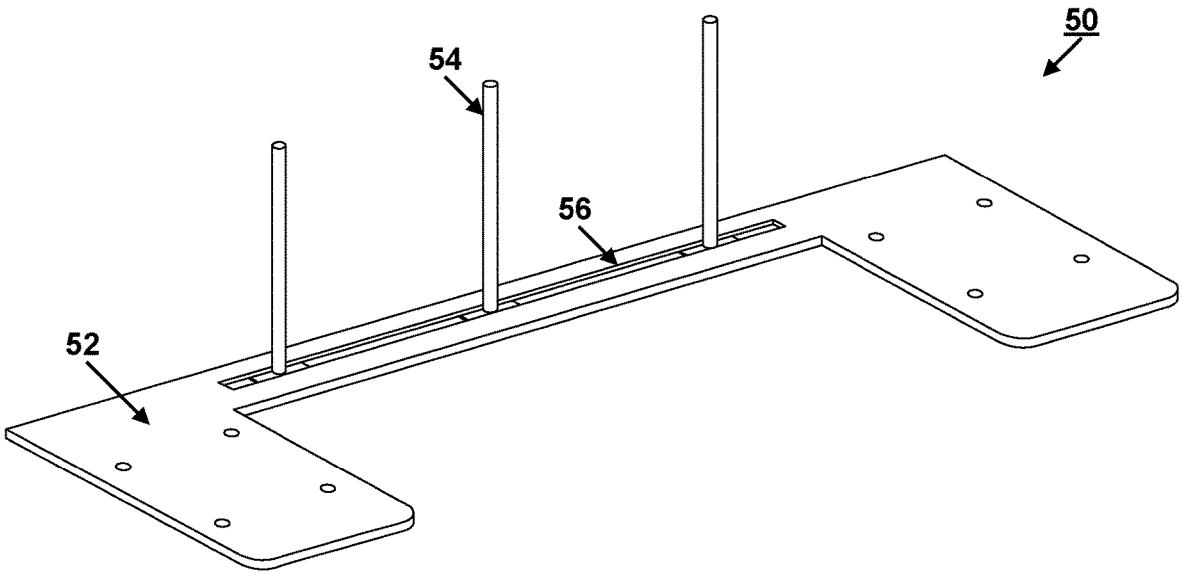
FIG. 6 is a perspective view of an alternative base plate configuration.

Most important is a foot member 14 which is fastened to the vertical post 12. A baseplate 16, upon which each vertical post 12 are supported, is fixed and connected to the base of the vertical posts 12. While the preferred embodiment employs a base plate for each vertical post, in alternative embodiments, the base plate can span the structure as shown in FIG. 6. It is the foot members 14 which shift the tipping rotation point from the forward leading edge of the base of the vertical posts 12 to the end 18 of the foot members 14. The invention leverages the mechanical advantage by placing the foot end immediately forward of the base of the vertical post 12.

Also important is the base and support plate structure 16 including vertical rods 20 which engage apertures 22 in weight modules 24. The invention leverages the mechanical advantage of placing weight modules 24 immediately rearward of the vertical posts 12. When fully assembled, the stabilizing structure 10 can provide resistance to longitudinal and lateral forces against the anchor points for exercise equipment at the top of the modular structure elements, In the absence of the stabilizing structure 10, such forces would be sufficient to cause the modular structure to tip and fall.

Figure 2:
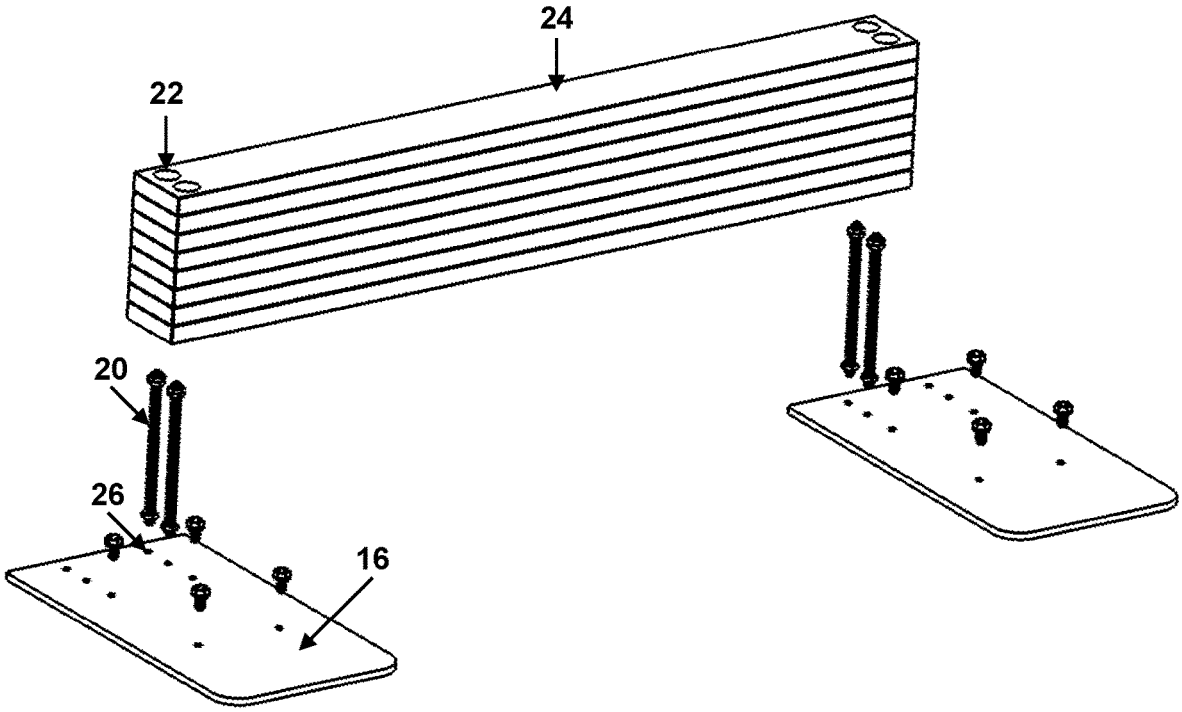
FIG. 2 is a perspective exploded view of a base plate suitable for use in the present invention.

FIG. 2 is a perspective exploded view of base plate 16. As shown, the vertical alignment rods 20 can be threaded and fitted into threaded apertures 26 of the support plate to accommodate the apertures 22 in the weight modules 24.

Figure 3A:
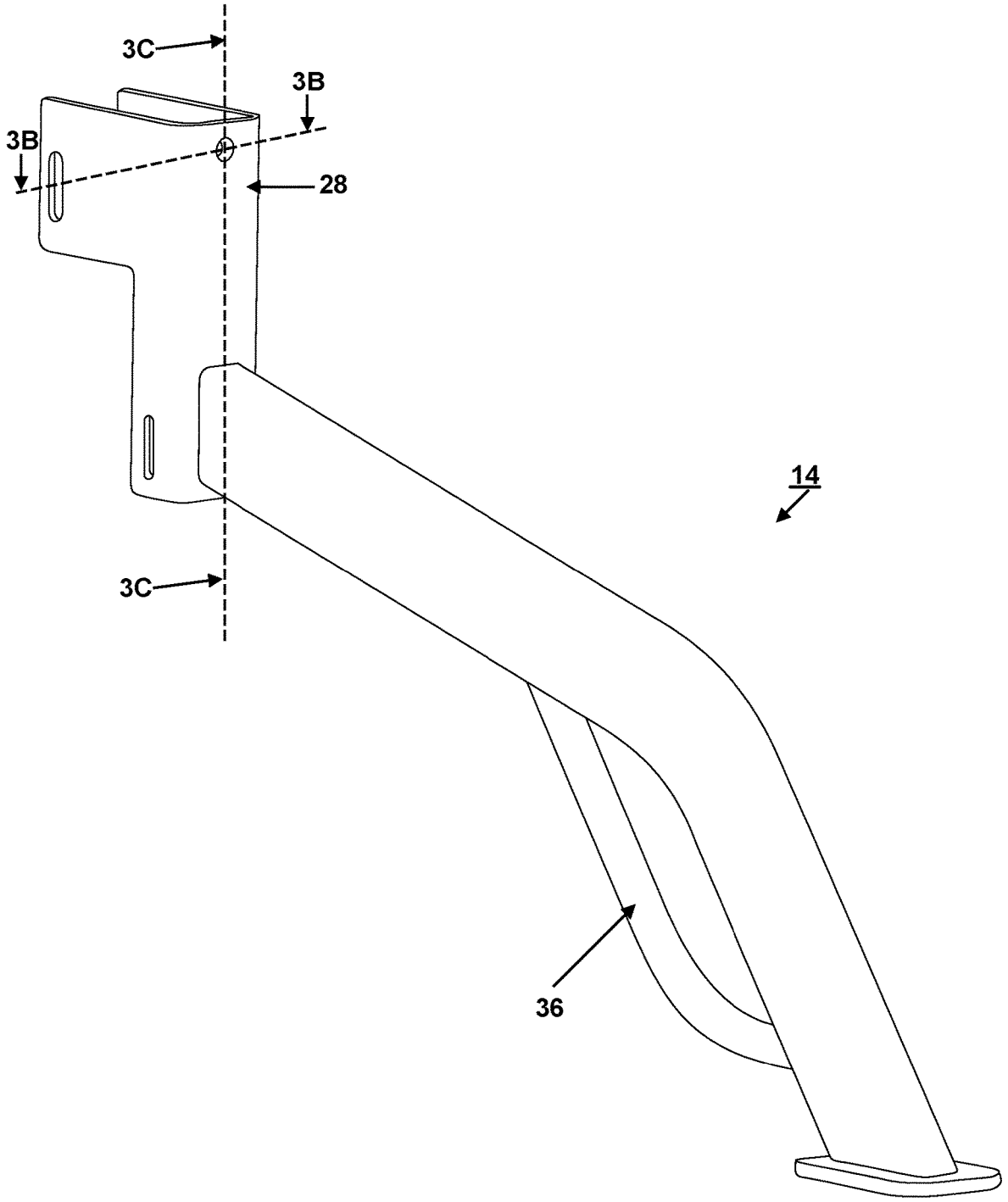
FIGS. 3A, 3B, and 3C is a perspective and sectional views of a foot element that may be attached to a modular structure.
Figure 3C:
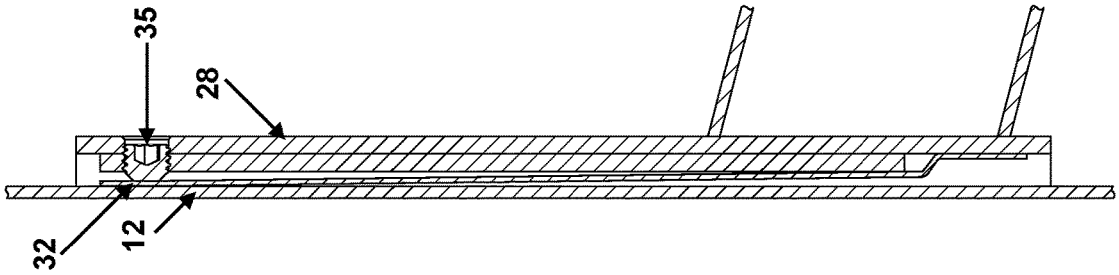
Figure 3B:
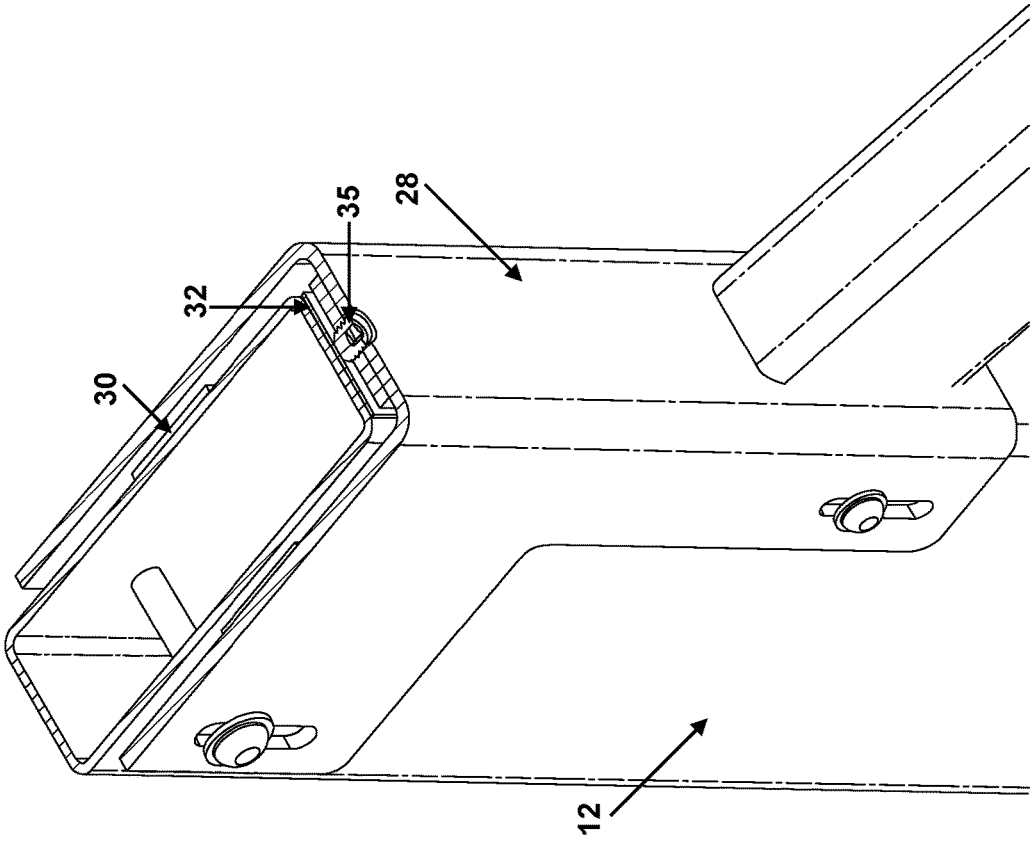

In FIG. 3A, the foot member 14 is shown in greater detail. A U-shaped bracket 28 is sized to fit over the vertical post 12 of the modular structure. The bracket 28 has an internal shim 30 to assure a tight lateral fit on the post 12. A compressible gasket 32, best seen in FIG. 3C, covers the forward internal surface of the bracket 28 to assure a tight fit when the foot member 14 is fixed to the vertical post 12. In the preferred embodiment, a set screw 35, best seen in FIG. 3B, maintains a compressive preload on the bracket 28, tightly mating the bracket 28 to the vertical post 12 while compressing gasket 32 to eliminate any free play in the connection due to manufacturing tolerances and also provides a force biasing the end if the foot member into the floor surface. The foot member 14 has an anchoring loop 36 to which exercise apparatus (not shown) can be fastened.

Figure 4:
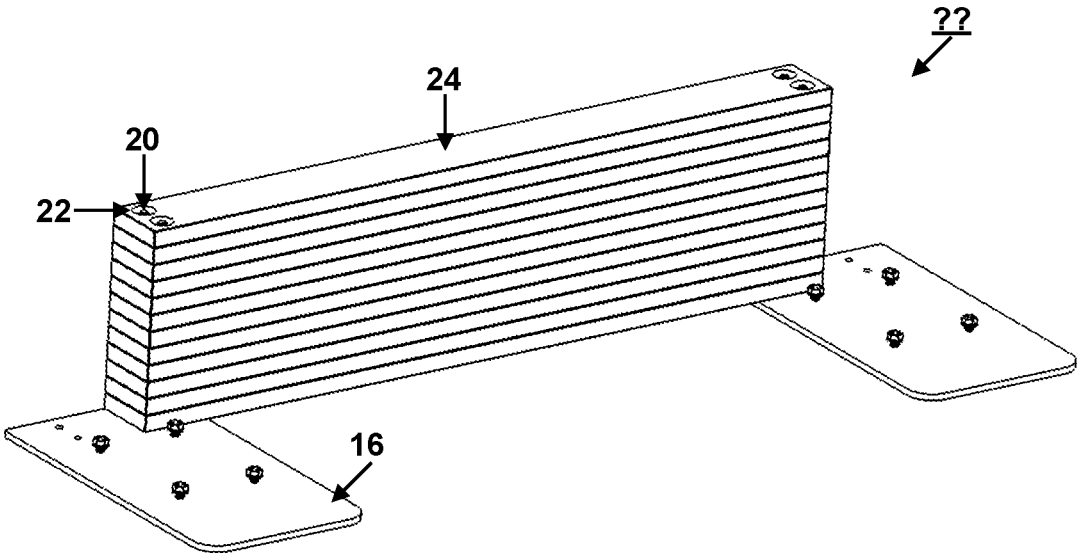
FIG. 4 is a perspective view of the base plate of FIG. 2 with weights installed.

FIG. 4 shows the base plates with stacked weight modules 24 held in place by the vertical alignment rods 20 in the apertures 22. Depending on the configuration of the modular structure, the requisite number of weight modules can be utilized to act as a counterweight.

Figure 5:
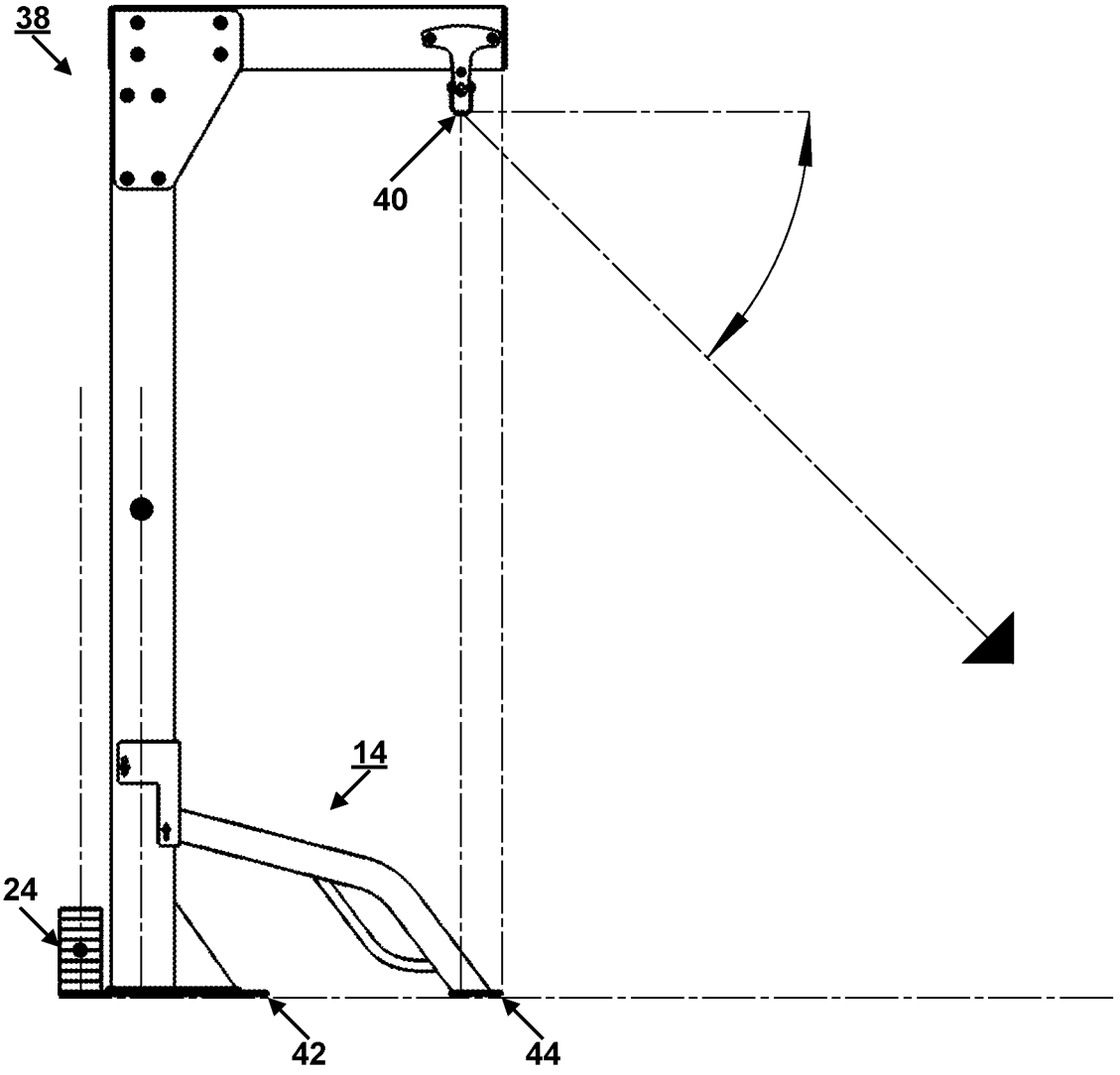
FIG. 5 is a side view of a modular structure showing the mechanics of the stabilization by relocation of the tipping point and added counterweight.

Turning next to FIG. 5, a modular structure 38 is shown in side view. An anchor point 40 can be at the upper portion of the structure 38. When using apparatus connected to that anchor point 40, a substantial load is brought to bear. The load direction may be anywhere, commonly between 30 to 90 degrees below horizontal. Without the present invention, the tipping point 42 is at the base of the vertical post 12 of modular structure 38. By adding the foot member 14, the new tipping point 44 is moved outward. This enables the mass of the modular structure 38 to resist rotation and the number of weight modules 24 needed to resist rotation can be relatively modest.

Turning to FIG. 6, there is shown an alternative embodiment of a base plate 50. In this embodiment, the base plate spans the separation between vertical posts 12 and has a plate portion 52. adapted to connect to each vertical post 12. Vertical alignment rods 54 are mounted in a slot 56 so that various sized and apertured weight modules can be installed.

Thus there has been shown and described, a novel system for stabilizing modular structures that have the potential of falling without the need to fasten such structures to a supporting floor or adjacent wall. The system allows for scalability to resist increased loading by increasing the weight modules. This permits greater flexibility in the placement of the modular structures and the configuration of the space in which they are located without sacrificing safety.

What is claimed is:

1. A modular structure having spatially separated vertical support members, the modular structure comprising:

one or more base plates, the one or more base plates collectively defining a forwardmost edge and a rearwardmost edge, each vertical support member extending upward from one of the one or more base plates between the forwardmost edge and the rearwardmost edge;

at least one weight module positioned above at least one of the one or more base plates such that each vertical support member is positioned between the at least one weight module and the forwardmost edge collectively defined by the one or more base plates; and a foot member fixed to each vertical support member above the one of the one or more base plates from which the vertical support member extends, each foot member extending beyond the forwardmost edge collectively defined by the one or more base plates such that, in use, each foot member and the one or more base plates engage an underlying surface.

2. The modular structure of claim 1, wherein each vertical support member extends upward from a different base plate of the one or more base plates.

3. The module structure of claim 2, wherein the at least one weight module extends between and is positioned above at least two base plates of the one or more base plates.

4. The modular structure of claim 1, wherein the foot member is detachably fixed to each vertical support member.

5. The modular structure of claim 1, wherein the foot member terminates in an end which is spaced apart from the one or more base plates.

6. The modular structure of claim 1, further comprising at least one vertical indexing rod proximate the rearwardmost edge collectively defined by the one or more base plates;

wherein the at least one weight module defines an aperture and the at least one vertical indexing rod is configured to engage the aperture of the at least one weight module.

7. A modular structure having spatially separated vertical support members, the modular structure comprising:

one or more base plates, each of the one or more base plates having a forward edge and a rearward edge, each of the one or more base plates underlying one or more of the vertical support members with the one or more vertical support members attached to the one or more base plates between the forward edge and the rearward edge;

at least one weight module operably connected to the one or more base plates such that each vertical support member is positioned between the at least one weight module and the forward edge of the one or more base plates underlying the vertical support member; and one or more foot members, each of the one or more foot members detachably fixed to one vertical support member above the one or more base plates underlying the vertical support member, each of the one or more foot members extending beyond the forward edge of the one or more base plates such that, in use, each of the one or more foot members and each of the one or more base plates engage an underlying surface.

8. The modular structure of claim 7, wherein each vertical support member extends upward from a different base plate of the one or more base plates.

9. The module structure of claim 8, wherein the at least one weight module extends between and is positioned above each of the one or more base plates.

10. The modular structure of claim 7, wherein each of the one or more foot members terminates in an end which is spaced apart from the one or more base plates.

11. A modular structure having spatially separated vertical support members, the modular structure comprising:

a base plate having a forward edge and a rearward edge, the base plate underlying one or more of the vertical support members with the one or more vertical support members positioned above the base plate between the forward edge and the rearward edge;

at least one weight module resting on the base plate such that each vertical support member attached to the base plate is positioned between the at least one weight module and the forward edge of the base plate; and a detachable foot member extending beyond the forward edge of the base plate such that, in use, the foot member and the base plate engage an underlying surface.

12. The modular structure of claim 11, wherein the detachable foot member terminates in an end which is spaced apart from the base plate.

13. The module structure of claim 11, wherein the at least one weight module extends between two base plates, the two base plates including the base plate, each of the two base plates underlying a corresponding vertical support member.

14. A modular structure having spatially separated vertical support members, the modular structure comprising:

one or more base plates, each base plate having a forward edge and a rearward edge, each vertical support member extending upward from one of the one or more base plates between the forward edge and the rearward edge;

at least one weight module positioned adjacent to at least one of the one or more base plates such that each vertical support member is positioned between the at least one weight module and a forwardmost of the forward edges of the one or more base plates; and a foot member extending beyond a forwardmost of the forward edges of the one or more base plates such that, in use, each foot member and the base plate engage an underlying surface;

wherein, the foot member has a leading edge positioned further away from the vertical support members than the forwardmost of the forward edges of the one or more base plates, such that when a force is applied to an upper portion of the vertical support members parallel to the underlying surface, the leading edge of the foot member functions as a point of rotation for the modular structure and the at least one weight module acts as a counterweight to prevent the modular structure from tipping about the point of rotation at the leading edge of the foot member.

15. The modular structure of claim 14, wherein a foot member is detachably fixed to each vertical support member.

* * * * *